United States Patent [19]

Makarowski

[11] Patent Number: 5,069,001

[45] Date of Patent: Dec. 3, 1991

[54] PIVOTABLE WINDOW SASH ASSEMBLY

[75] Inventor: Anthony Makarowski, Syosset, N.Y.

[73] Assignee: Insul-Lite Window Manufacturing, Inc., Garden City, N.Y.

[21] Appl. No.: 616,642

[22] Filed: Nov. 21, 1990

[51] Int. Cl.[5] ..... E05D 15/22

[52] U.S. Cl. ..... 49/176; 49/181

[58] Field of Search ..... 49/176, 181, 182, 161, 49/430, 446

[56] References Cited

U.S. PATENT DOCUMENTS

| | | | |
|---|---|---|---|
| 3,844,066 | 10/1974 | Nobes | 49/181 |
| 3,861,082 | 1/1975 | Dau | 49/181 |
| 3,959,926 | 6/1976 | Noecker et al. | 49/181 |
| 4,363,190 | 12/1982 | Anderson | 49/181 |
| 4,581,850 | 4/1986 | Simpson . | |
| 4,590,708 | 5/1986 | Campodonico | 49/181 |
| 4,683,676 | 8/1987 | Sterner | 49/176 X |
| 4,718,194 | 1/1988 | FitzGibbon et al. | 49/181 |
| 4,763,445 | 8/1988 | Silverman | 49/176 |
| 4,785,581 | 11/1988 | Abramson et al. | 49/176 |
| 4,926,524 | 5/1990 | Owens | 49/176 X |
| 4,930,254 | 6/1990 | Valentin | 49/176 X |
| 4,958,462 | 9/1990 | Cross | 49/181 |

FOREIGN PATENT DOCUMENTS

| | | | |
|---|---|---|---|
| 1388819 | 3/1975 | United Kingdom | 49/176 |

*Primary Examiner*—Gary L. Smith
*Assistant Examiner*—Jerry Redman
*Attorney, Agent, or Firm*—Bauer & Schaffer

[57] ABSTRACT

A tiltable window sash mounted in a channelled window frame having a T-shaped bar projecting from the sash into the window frame channel, with the wings of the T-Bar engaging the inside of the window frame channel so that sash to frame alignment is maintained. The bar simultaneously provides a pivotal axis about which the sash is tilted. The bar engages a sliding pivot shoe located in the window frame channel to provide a guide for sliding of the sash. The pivot shoe has a cam operated dial acting brake; the cam is coupled to the T-shaped bar, so that the sash is tilted; the cam operates a first brake preventing sliding of the tilted sash, and when a predetermined angle of sash tilt is reached, a second brake is operated by the cam preventing further tilting of the sash, thus supporting the sash in a tilted position.

9 Claims, 2 Drawing Sheets

PIVOTABLE WINDOW SASH ASSEMBLY

BACKGROUND OF THE INVENTION

The present invention relates to double-hung window assemblies and particularly to such windows having pivotally mounted sashes.

Pivoting sashes have become quite common in double-hung window assemblies as they have the usual advantage of being able to be raised and lowered as well as the special advantage of being tiltable to make cleaning of the window pane easier. Attention is directed to U.S. Pat. No. 4,581,850 which illustrates a double hung pivotal window assembly. While the structure of this patent and other similar commercial double hung pivoting assemblies have overcome many of the disadvantages of the prior window assemblies, several disadvantages still exist.

For example, a problem still arises where, during manufacturing and installation of the conventional assemblies, a "belly band" or similar elastic constriction must be used to maintain the assembly together so that the assembly remains truly square when installed in the window opening. Such "belly bands" while necessary, are a particular nuisance during transport and storage, since they must be kept in place during and after installation.

Another disadvantage occurs as a result of the inability to mount the sash to the sash frame, so that binding and warping of the sash frame are prevented. Still another problem arises out of the inability of locking the pivot sash in an open position so as to remove any stress on the pivot joint caused by its weight.

It is the object of the present invention to provide an improved pivotal sash assembly to overcome the aforementioned disadvantages as well to provide numerous other advantages will be obvious to persons skilled in the art from contemplation of the following disclosure.

SUMMARY OF THE INVENTION

According to the present invention, a sash retaining and pivot assembly is provided which engages cooperatively with the sash weight slide. The pivot assembly is provided with a connecting T-Bar having wings which fit together with the slide, within the jamb frame channel so as to hold the jamb frame and sashes in a unitary manner. Further, the pivot assembly and the weight slide cooperate to effect locking of the sash in pivoted position.

The sash retaining pivot assembly of the present invention, when used within a window constructed with a "tilt in to clean" feature, will provide integral locking of the window sash within the window frame at the pivot location. While still allowing removal of the sash at a 90 degree tilt, the self aligning locking mechanism will engage and secure the sash within the frame at approximately a 60 degree tilt.

A window incorporating the sash retaining pivot assembly will provide advantages during window installation, as well as after window installation. During window installation, the sash retaining pivot assembly will retain alignment of the sash with the frame without the use of a "belly band". This will allow for easier shimming and squaring of the window within the opening.

After the window is installed within the opening, the sash retaining pivot assembly will continue to benefit the window construction by maintaining the alignment of frame to sash, which will provide the window with a constant and proper spacing between frame and sash.

DESCRIPTION OF THE INVENTION

Figure 1:
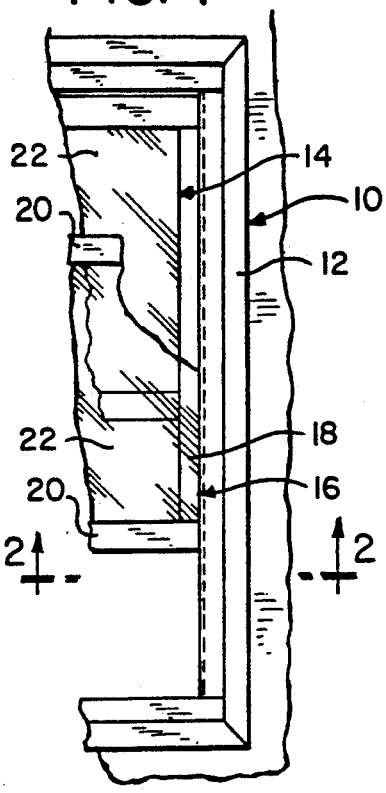
FIG. 1 is a fragmentary front elevational view of a double hung window assembly of a type to which the present invention is applied.

The present invention is depicted in connection with double-hung windows of the type illustrated in FIG. 1, by the numeral 10. Such windows include a rectangular main jamb frame 12, forced of elongated channel sections, and a pair of sashes 14 and 16. The sashes have opposing vertical stiles 18, a top and bottom header 20 and a glass pane 22. The frame 12 and sashes 14 and 16 can be formed of metal although strong rigid plastic is currently preferred because of its thermal properties, ease of fabrication, strength and decorative durability. In general, the form of the sashes and jamb will follow conventional structure and form. Those features not of a conventional nature will be described herein and reference can be made to the aforementioned patent and others as well as commercial windows for the conventional features.

Figure 2:
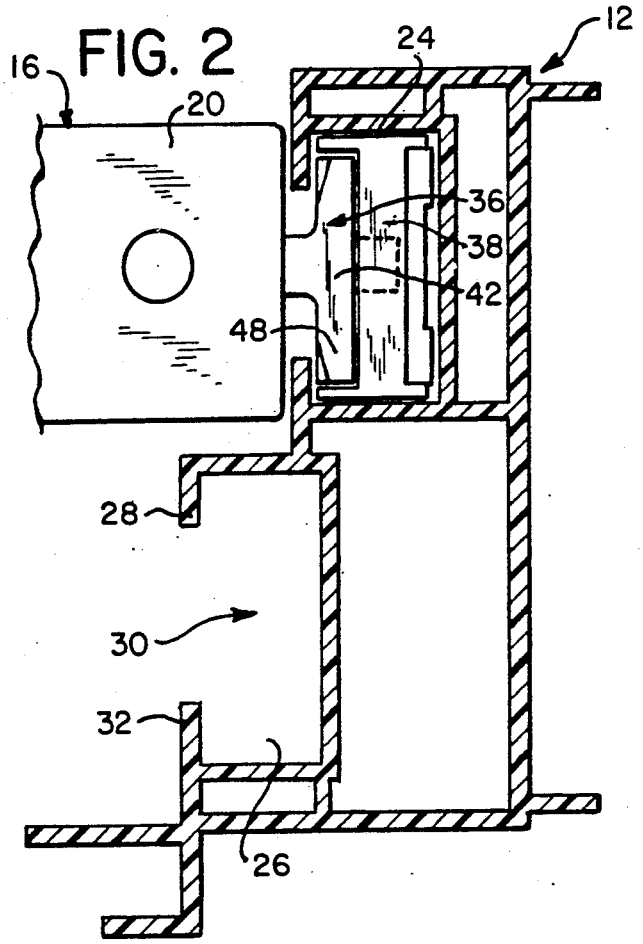
FIG. 2 is a sectional view along lines 2—2 of FIG. 1 showing the sash retaining assembly and weight slide assembly connecting the sash and jamb frame.

According to the present invention, the frame 12 as seen in FIG. 2 comprises an elongated continuous extrusion having in cross-section a inner sash channel 24 and an outer sash channel 26, each of which is cross sectionally C-shaped to provide an inwardly directed flange 28 defining a continuous slot 30. The exterior surfaces of the flanges 28 provide straight, smooth guides 32 against which the stiles 18 of the associated sash slide. If desired, as seen in FIG. 3 a pad of fabric, rubber or the like forming a slidable seal member 34 is adhered to the stile 18 to seal the space between the sash and the frame.

The sashes 14 and 16 are not only independently movable up and down within the frame, but are pivotal with respect to the frame to facilitate cleaning, maintenance and replacement of parts. To this end, the opposite sides of each sash is provided with a sash retaining assembly 36, fixed to the sash, and a slidable pivot-shoe assembly 38 located in the associated frame channel. Although only one such pair of retaining assemblies 36 and pivot shoe assemblies 38 are shown, it will be understood that each sash has two pairs, one pair on each of the right and left sides of the sash.

Figure 3:
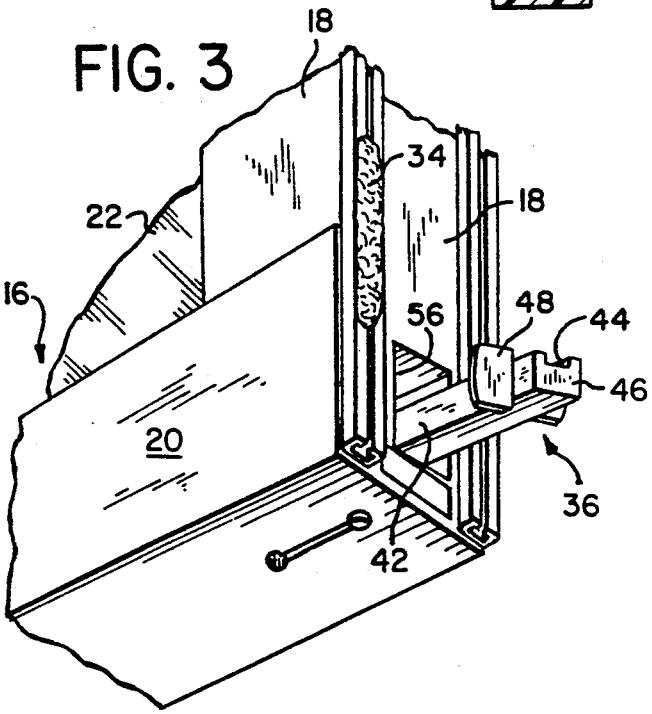
FIG. 3 is a fragmentary perspective view of the bottom corner of the window sash of FIG. 1 showing the sash retaining assembly extending from the sash.
Figure 4:
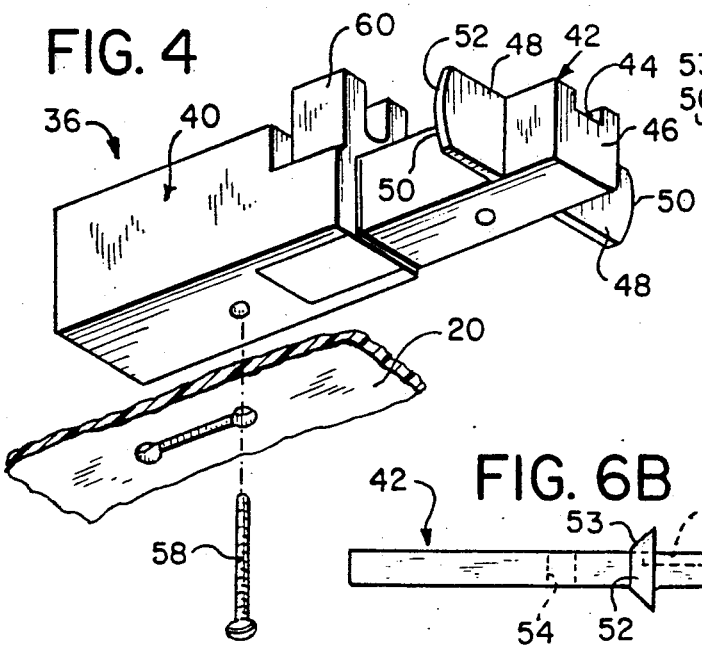
FIG. 4 is an enlarged view of the sash retaining assembly removed from the sash and the mounting bracket for securing the same to the sash.
Figure 6A:
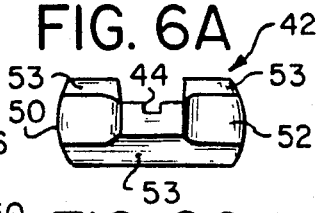
FIG. 6A is a detailed view of the T-Bar looking at its end.
Figure 6C:
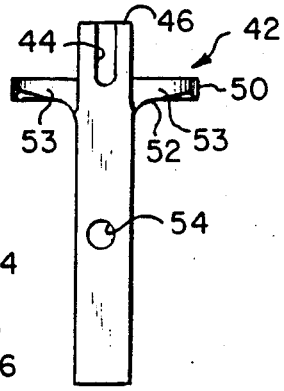
FIG. 6C is a top plan view in detail of the T-Bar.
Figure 6B:
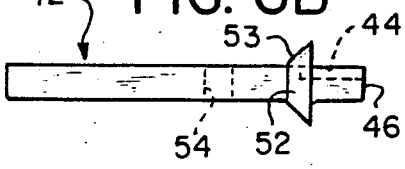
FIG. 6B is a side elevational detail of the T-Bar.
Figure 5A:
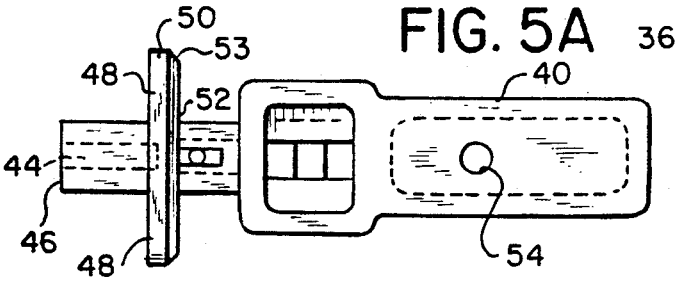
FIG. 5A is a bottom plan view of the unitary embodiment of the T-Bar and guide of the sash retaining assembly.
Figure 5B:
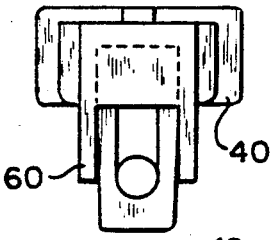
FIG. 5B is an end view of the T-Bar guide of FIG. 5.

As seen in FIGS. 3 and 4, the sash retaining assembly 36 comprises an enlarged box-like body 40 from the forward end of Which extends a T-Bar 42. The body 40 and T-Bar 42 may be unitarily molded or cast as depicted in FIGS. 5A–5B or may be formed of two parts that frictionally fit together using the T-Bar of FIGS. 6A–6C. Preferably, as seen in detail, the T-Bar is separate so that it may be adjusted longitudinally. T-Bar 42 has a generally rectangular cross-section with a longitudinally directed groove 44 on its upper side forming a keyed front end 46. Set back from the forward end of the T-Bar and extending perpendicular to its axis are a pair of oppositely extending lateral wings 48 having arcuate extreme edges 50 and a back surface 52 which has beveled ramps 53 on at least one edge. At least one hole 54 is formed in bottom of the body 40 between the two larger sides.

Returning to FIGS. 3 and 4 the body 40 of the assembly 36 is inserted within a receiving hole 56 formed in the stile or header of the sash (14, 16) and held fixedly in place by a bolt 58 so the arms 48 are spaced predeterminately from the surface of the stile 18 or the associated header 20. The body 40 may be shaped and provided with enlarged embossment to such walls 60, etc. so that when so inserted, will not twist within the receiving hole 56.

Figure 7:
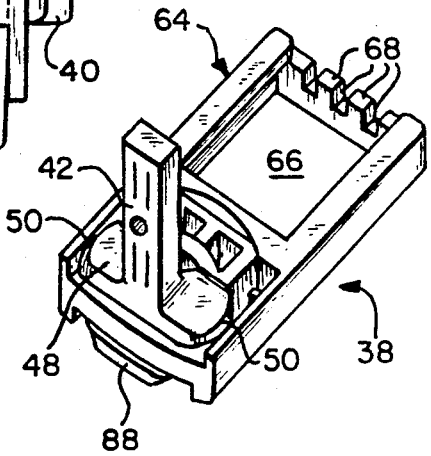
FIG. 7 is a perspective view of the pivot shoe showing the T-Bar inserted therein.

The slidable pivot shoe assembly 38, as shown in FIG. 7 consists of a flat molded plastic slide 64 of substantially rectangular shape and of width and thickness so as to be closely and slidably received in channels 24, 26. The upper approximately two thirds of the slide 64 is provided with an enlarged window 66 bounded at its upper edge with a number of slots and fingers 68. The slots 68 and window 66 cooperate to receive and hold the ends of any sash balance and weighted cords (not shown).

Figure 8A:
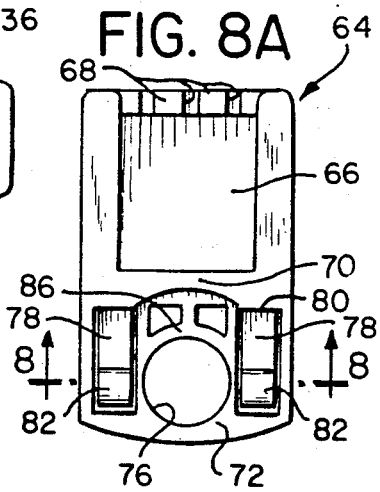
FIG. 8A is a plan view of the pivot shoe.
Figure 8B:
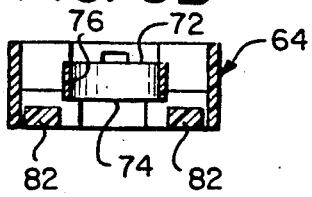
FIG. 8B is a sectional view along line 8—8 of FIG. 8A.

Turning now to FIGS. 8A and 8B, the remaining portion of the slide 64 is formed with a web 70 and both front and back faces 72 and 74 respectively. Front face 72 is cut back to form a recessed area. Passing through the slide 64 is a central bearing hole 76. Extending from the web 70 are a pair of brake shoes or flaps 78 located on either side of the central bearing hole 76. Each retaining flap 78 is integrally attached at its interior ends 80 to the web 70 at the front of slide 64, while the open end of each flap 78 is freely extending and enlarged to form a depending stop 82 so that the flap is resiliently liftable when an object is inserted between the flap and the recessed front face. In the preferred embodiment of the instant invention, the back face 74 is formed with a recessed portion 86, so that the wings 48 of T-Bar 42 can be fitted and rotated within the dimensional envelope of pivot shoe assembly 38, allowing the wings 48 of T-Bar 42 to be positioned within the same channel 24, 26 with the pivot shoe.

Figure 9A:
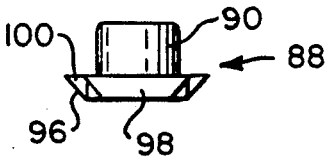
FIG. 9A is an elevational view of the rotary cam used in the slide.
Figure 9B:
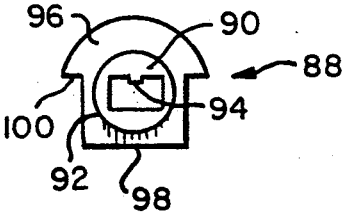
FIG. 9B is a plan view of the rotary cam.

Set within the bearing hole 76 from the front recessed face 72 is a rotary cam 88 (FIGS. 9A and 9B) having a cylindrical hub 90 in which is formed a rectangular bore 92, of sufficient size to permit entry of the extending forward end 46 of the T-Bar 42. An elongated key 94 extends the length of the bore 92 so as to mate with the keyway 46 in the T-Bar 42 insuring only proper entry of the T-Bar into the cam. A semi-circular flange 96, extends radially from the front end of cylinder hub 90. The flange having beveled lateral wings 100 are being integrally formed at one side of the front end of cylindrical hub 90 while the opposite side has a straight edge 98.

The cam 88 is set within the central bearing hole 76 so that the arcuate flange 96 lies interiorly in the recessed area of front face 72 and the wings 100 lie between recessed front face 72 and the flaps 78. In this manner the straight edge 98 lies between the flaps 78 against the stops 82 in a resiliently locked position. Upon exertion of rotary force on the cam 88, the beveled wings 100 of the flange 96 wedge beneath the stops 82 of flaps 78 forcing the flaps 78 away from front face 72 allowing the cam to rotate until the opposing square corners of the straight edge 98 abut against stops 82. The locked position and the rotated position define the extreme positions in which the sash is pivoted.

Mounting of the sash within the frame should now be clear. The pivot shoe assembly 38 is prepared i.e., the slide 64 and the cam 88 is assembled. Thereafter, the forward keyway 46 of the T-Bar 42 is inserted in the rectangular bore 92 of the cam 88 and the window sash with the entire retaining assembly placed between the opposed jamb frame 12. In making this placement, the pivot shoe assembly 38 and the lateral wings 48 of the T-Bar 40 are placed within the appropriate slot 30 in the jamb frame 12, as seen in FIG. 2, so that the pivot shoe assembly is slidable therein. Since the back face 74 of the slide 64 is cut back to form a recess, both the slide 64 and the lateral wings 48 of the T-Bar sit between the inner surface of the flange 28 and the bottom wall of the channel 30, holding the sashes and the jamb frame 12 square with each other. Attachment of the bolt 58 in this condition joins the retaining assembly 36, including the T-Bar 42 to the sash and attaches the entire unit to the jamb frame in a unitary manner for transport and storage. As a result, the entire window assembly becomes a single unit obviating the need for the conventional "belly band" or other strapping.

Because the flaps 78 pivot only in response to the turning of the cam from the back side of the slide 64, the slide may move freely along the length of the channel until the beveled edge 98 is forced beneath the flaps 78. When this occurs, the flaps frictionally engage the bottom wall of the channel and acts like a shoe brake arresting movement of the slide and thus of the window. Because the T-Bars are firmly fixed to the sash and the wings 48 fit behind the flanges 28 of the channels, the frames are captivated to the sash, and cannot belly out i.e., bow or warp, during or after installation, nor during storage and transportation when there is no jambs support for them.

In operation, the installed double hung window assembly of the present invention functions in the generally conventional manner, in that the sashes are freely movable upward and downward against their balance weights. When desired, either one of the sashes may be pivoted inwardly causing the retaining assembly 36 to be rotated resulting in rotation of T-Bar 42, and thus, the cam 88. As cam 88 rotates, its flange 96 causes the flaps 78 to pivot outwardly, forcing them to press with great frictional force against the inside wall of the channel 30 until this force overcomes any desire for the sash to move upwardly or downwardly or to further pivot. Thus, in this tilted position, the pivot window is held fast and securely against inadvertent movement. It may be washed or repaired etc., without fear of change.

It will be clear that the slide and T-Bar can be assembled with either the upper or lower sash, and merely by adjusting the extension of the T-Bar from the stile will fit into either the front or rear channel of the jamb frame 12. In either situation the pivot assembly will function in the same way. Likewise, the pivot assembly is obviously applicable to windows with horizontally slidable/rotatable sashes.

Various modifications, changes and embodiments have been disclosed herein. Others will be obvious to those skilled in the art. Accordingly, it is to be understood that the foregoing disclosure is illustrative only and not limiting of the invention.

What is claimed is:

1. An apparatus for mounting a tilt window sash to a channeled window frame, comprising a pivot shoe, said pivot shoe having a side with a recessed area facing the sash, said pivot shoe being slidably located in the channel of the window frame, and a T-Bar having an elongated body with inner and outer ends and a pair of radially extending wings near the outer end of said body, the inner end of said body being adapted for mounting to the window sash, the outer end and wings of said T-Bar projecting from the sash into said pivot shoe so that the wings of said T-Bar lie rotatably within the recess of said pivot shoe in the window frame channel, the body of said T-Bar providing a pivotal axis for tilting the sash, the outer end of said body engaging said pivot shoe and said wings engaging the window frame channel to maintain alignment of the window frame and sash assembly.

2. The apparatus as set forth in claim 1, further comprising means for adjusting the mounted position of said T-Bar.

3. The apparatus as set forth in claim 1, wherein said body has walls of sufficiently large dimensions so that rotation of said body relative to the sash is prevented when said body is mounted in the sash and the sash is tilted relative to the window frame.

4. The apparatus as set forth in claim 1, wherein said pivot shoe has a bore transversely therethrough and a rotatable cam in the bore, said cam having a cylindrical hub, said hub being adapted to engage the outer end of said T-Bar so that said pivot shoe, when engaged with said T-Bar, provides a guide for the sliding and tilting of the sash in the window frame.

5. The apparatus as set forth in claim 4, wherein said pivot shoe has an upper edge and one or more fingers extending from said upper edge, said one or more fingers being adapted for cooperatively engaging a window counterbalance means.

6. The apparatus as set forth in claim 4, wherein the outer end of said T-Bar has a longitudinal slot, and said hub has a key adapted to engage said slot so that when said T-Bar and said hub are engaged, said slot and said key engage, and said T-Bar and said hub are locked together so as to rotate conjointly in said pivot shoe when the sash is tilted.

7. The device as recited in claim 6, wherein said pivot shoe further comprises brake means for frictionally engaging the window frame channel, said brake means being responsive to tilting of the sash in the window frame, so that when the sash is tilted in the window frame, said brake means frictionally engages the window frame channel preventing said pivot shoe, and thus the sash from sliding in the window frame.

8. The device as recited in claim 7, wherein said pivot shoe brake means comprises:

a) one or more outward facing brake flaps, each of said brake flaps having a first end joined to said pivot shoe, and a second end freely extending from said first end, said brake flap being positioned alongside the bore in said pivot shoe; and b) a beveled semicircular flange extending radially from a first end of said hub of said cam, said semicircular flange being positioned underneath said second end of said brake flap, so that when the sash is tilted, said T-Bar causes said cam to rotate, forcing said second end of said brake flap to slide up the beveled edge of said semicircular flange, said brake flap being spread outwardly from said pivot shoe, and said second end of said brake flap frictionally engages the window frame channel, preventing sliding of said pivot shoe in the channel, and consequently preventing the sliding of the sash in the window frame.

9. The device as recited in claim 8, wherein said cam further has a squared flange extending radially from said first end of said hub, said squared flange being diametrically opposite said semicircular flange, said squared flange having dimensions selected so that said squared flange engages underneath said brake flap substantially at a predetermined angle of sash tilt, so that further tilting of the sash is prevented and the sash is supported substantially at said predetermined angle.

* * * * *